United States Patent [19]

Hunter

[11] 4,070,278

[45] Jan. 24, 1978

[54] MAGNETIC SEGREGATION OF MIXED NON-FERROUS SOLID MATERIALS IN REFUSE

[75] Inventor: Jack A. Hunter, Long Grove, Ill.

[73] Assignee: UOP Inc., Des Plaines, Ill.

[21] Appl. No.: 655,038

[22] Filed: Feb. 3, 1976

[51] Int. Cl.[2] ..... B03C 1/14

[52] U.S. Cl. ..... 209/212; 209/223 R

[58] Field of Search ..... 209/223 R, 212–215, 209/127–130, 231, 227

[56] References Cited

U.S. PATENT DOCUMENTS

| | | | |
|---|---|---|---|
| 695,080 | 3/1902 | Ramspeck | 209/215 X |
| 731,040 | 6/1903 | Gates | 209/212 |
| 731,044 | 6/1903 | Gates | 209/212 |
| 1,657,405 | 1/1928 | Machaven | 209/223 R |
| 2,235,305 | 3/1941 | Wiegand | 209/127 A |
| 3,824,516 | 7/1974 | Benowitz | 209/212 X |

FOREIGN PATENT DOCUMENTS

| | | | |
|---|---|---|---|
| 26,590 | 5/1930 | Australia | 209/212 |
| 2,509,638 | 9/1975 | Germany | 209/212 |
| 2,059,166 | 6/1972 | Germany | 209/223 R |

*Primary Examiner*—Robert Halper

*Attorney, Agent, or Firm*—James R. Hoatson, Jr.; Philip T. Liggett; William H. Page, II

[57] ABSTRACT

After an initial separation of paper, plastics and the light fibrous types of materials, as well as magnetically removable ferrous metals, from refuse material, it is subjected to a "time-of-flight" type of segregation where a magnetic field is used to influence the downward free-fall of the remaining mixed solids materials. In combining a magnetic field with gravity fall, there is a retarding force on each conductive piece of material which is related to its conductivity and volume. As a result, different types of material fragments of about the same size will have different descent times in the drop zone which will depend primarily upon density and electrical conductivity and a rotatable diverter means, which is properly timed and synchronized in its movement with respect to the releases of unsegregated material, can provide for the deflection of the different types of materials into appropriate collecting zones.

4 Claims, 2 Drawing Figures

MAGNETIC SEGREGATION OF MIXED NON-FERROUS SOLID MATERIALS IN REFUSE

Figure 1:
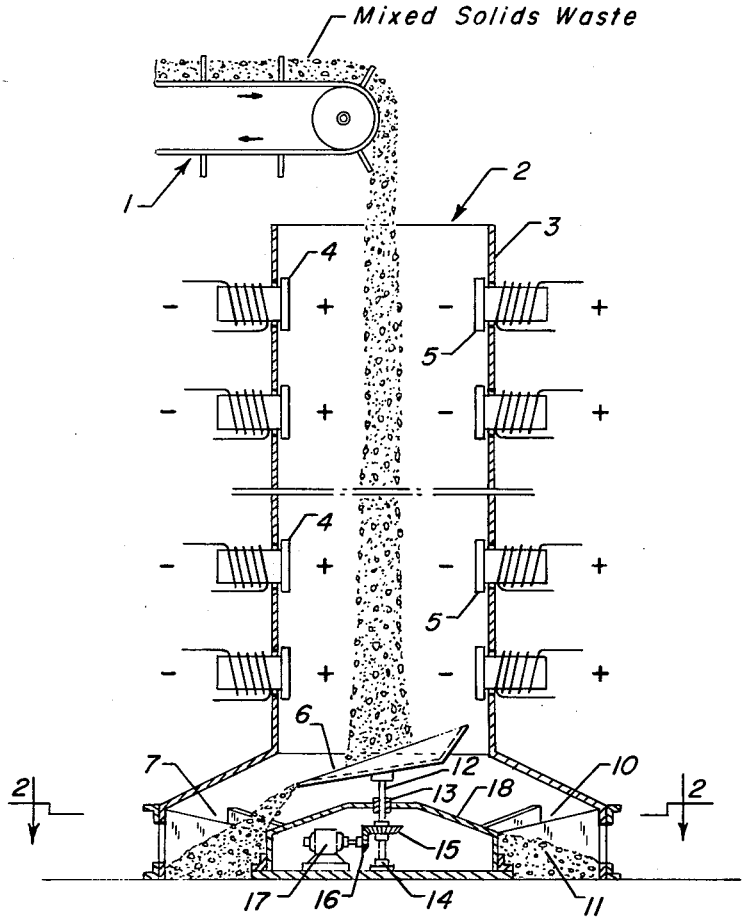

The present invention relates to a method for effecting the segregation of mixed, non-ferrous, solid materials in refuse by the use of a combination of gravity and the retarding force of a magnetic field acting on such material that may be at least partially electrically conductive.

More particularly, the present invention is directed to a timeof-flight type of separation procedure where a magnetic field is used to retard the downward free-fall of mixed, non-ferrous solids materials (with such retarding being proportional to both the conductivity and the volume of each particular fragment) so that in the special dropping zone different types of materials will have differing descent times in such zone and can be segregated by a properly timed and synchronized rotating diverter means.

Inasmuch as the present method of operation combines gravity and magnetic retarding forces to obtain a resultant effect, it is apparent that the descent rate for each fragment in the batch of mixed metals or mixed solids will be related to the conductivity and density of the particular fragment. For example, where fragmented pieces of material fall through a defined zone with a magnetic field provided to resist the descent of conductive materials, then non-conducting, high density material, such as glass and stone will descend most rapidly and, with various delay intervals, the metals such as lead, zinc, copper and aluminum, will emerge. These materials can be collected separately by having a diverter means, such as a rotatable deflector plate, be adjusted to rotate in a proper synchronization with the release of the unsegregated material at the top of the dropping zone.

In the handling and reclamation of solid waste, it is, of course, understood that the use of magnetic separations is an old and well-known procedure, particularly for removing and collecting the ferrous metals from refuse. In addition, magnetic eddy-current separations have been used to some degree to effect a separation of aluminum from refuse material; however, the use of magnetic forces in the present manner for segregating various metals, and non-metal materials from a mixture of non-ferrous metals is not believed to be in usage in any known processing operations, at least with respect to refuse handling plants. It is also realized that many types of magnetic separation and concentration procedures have been developed and are in use in connection with the handling of ores, ore tailings, etc. However, again it is to be noted that these types of operations are primarily involving the separation of ferrous materials and magnetically susceptible materials.

In the present instance, it may be considered a principal object of the invention to provide for the segregation of mixed non-magnetic materials by generating drag forces to influence the rate of fall of the various electrically conductive fragments in a particular batch of material being handled.

It may also be considered an object of the present invention to provide a system which integrates a properly timed and synchronized movable material diverter means such that as the various materials reach the lower end of a drop zone magnetic field they can be deflected into appropriate collecting bins, with such deflecting and segregating being, of course, after the various resulting retardations or delay intervals from generated and opposing magnetic forces have acted upon various of the metal fragments.

In a broad aspect, the present invention provides a method for segregating mixed solids materials, including mixed non-magnetic metals, that remain in refuse material after initial separations of low density materials such as plastics, paper and other light fibrous materials, which method comprises the steps of: (a) effecting the dropping of a batch of mixed solids materials downwardly through a defined vertically elongated dropping zone, (b) simultaneously providing a magnetic field for substantially the height of the dropping zone to cause material fragments to cut through the magnetic lines of force and result in effecting retarding forces on the conductive materials of said batch, proportional to the conductivity of each such piece of material and to its mass/density characteristics, (c) providing timed and synchronized diversions of the solids materials at the lower end of the dropping zone by movable particle deflector means to effect a plurality of resulting time-of-flight separations for the different materials, and additionally, (d) effecting the collection of segregated types of solids and metals within lower different areas of said dropping zone.

With shreading and air classifications to remove paper, cloth, plastics, and various fibrous materials, and magnetic removal of ferrous materials, there is a substantial reduction in the quantity of solid waste materials being introduced to the present time-of-flight type of separation and a more efficient overall operation results.

The magnetic field for the present vertically elongated dropping zone can be provided from permanent magnets or from electromagnets. The magnetic members should be spaced vertically along substantially the full height of the zone so as to insure the provision of a magnetic force field for substantially the full height of the zone. The length of the zone may, of course, vary in accordance with the nature of the mixed nonmagnetic metals being handled and the quantity of the material which will be falling with each batch operation. The longer the zone, the greater the cumulative effect of the retarding magnetic forces such that a more efficient segregation may be accomplished. As heretofore indicated, the magnetic field(s) should be provided from permanent magnets or from the use of electromagnets which will produce a non-reversing or non-alternating field since it is more economical to provide a non-alternating field. It should be noted, however, that even with an alternating field the forces generated on the falling particles or pieces are always such to retard the motion through the field and an alternating field could thus be employed.

In a preferred installation, it is also of advantage to have a wall or screening means around the material dropping zone in order to preclude random wind or air current interference with the falling stream of material. In some particular situations where low density film-like materials, or materials of grossly different size or shape are to be separated, it would facilitate separation to induce a movement of the air in the region through which the material to be separated falls where the velocity downward approximates the average velocity of the falling material, since this will minimize the effects of wind resistance which otherwise could interfere with separation.

Various types of diverter means can be used within the lower portion of the dropping zone as well as various types of collection areas provided to receive the segregated materials. For example, the diverter means may comprise a relatively simple form of sloping deflector plate which is gear connected, or otherwise linked, to suitable motor operated power means such that there is a resulting synchronized speed of rotation or intermittent angular movement of the deflector plate to insure that it will, in turn, receive and deflect the various types of materials which will reach the bottom of the dropping zone in a generally segregated manner. The starting and stopping of the rotatable diverter means, as well as the speed of rotation or angular positioning thereof, can be electrically connected to the material charging means at the upper end of the dropping zone by suitable electrical circuitry and switching means. For instance, where a conveyor belt means is utilized to periodically charge batches or mixed non-magnetic solids materials to the top of the dropping zone, then the stopping and starting of the conveyor belt should also provide for the starting and stopping of the rotatable diverter means such that the latter will be in operation to receive the descending segregated material. The orientation of the converter means or its rate of rotation in order to provide proper synchronization with the time-of-flight fall for the various fragments will, of course, be adjusted to suit the types of materials and the height of the particular dropping zone.

Reference to the accompanying drawing and the following descriptions thereof will serve to illustrate the operation of the present system and its advantages in effecting segregation of non-magnetic mixed materials.

FIG. 1 of the drawing is a diagrammatic sectional elevational view indicating an elongated dropping zone with a transverse magnetic field such that the dropped mixed solids materials will necessarily cut the lines of force of the magnetic field prior to reaching a lower particle diverter zone.

Figure 2:
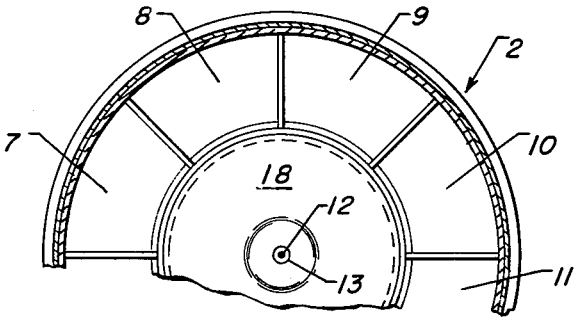

FIG. 2 of the drawing is a partial sectional plan view, as indicated by line 2—2 in FIG. 1, indicating that a plurality of radial collecting bins may be made available to receive the various segregated materials.

Referring now particularly to both FIGS. 1 and 2 of the drawing, there is indicated a conveyor means 1 which is suitable to carry mixed metals and solids from a refuse or waste reclaiming operation where preferably, should such materials be present, there has been a series of preliminary classification steps to remove paper, plastics, cloth or other light weight fibrous types of materials, as well as a preliminary removal of ferrous materials by magnetic separation. These various conventional separation procedures will result in providing a mixture of high density materials which would include various non-magnetic metals, as well as glass, rocks, etc. These high density materials are fed from the conveyor means 1 in a series of timed batches into the upper end of a dropping zone 2 which is defined by a shield or encompassing wall 3 to undergo an elongated fall through a magnetic field maintained throughout the substantial full height of the dropping zone 2. On opposing sides of the zone 2, there is diagrammatically indicated the use of a plurality of opposing magnets 4 and 5, with magnets 4 being indicated as positive and magnets 5 being indicated as negative. Although permanent magnet members may be utilized, the present embodiment indicates the use of electromagnets which will have suitable windings to insure opposing north-south poles for each side of the dropping zone.

In accordance with the resulting time-of-flight separation obtained from this operation, it will be evident that non-conducting high density materials, such as glass and stone, will fall through the entire dropping area without having any retarding forces generated from the magnetic field and, as a result, will reach a lower rotatable deflector member 6 to, in turn, be diverted into an appropriate collector bin, such as at 7. On the other hand, those materials which have conductive properties will be subjected to retarding forces generated in each fragment thereof which is proportional to its conductivity and volume. However, the drag force or retardation will be related to the conductivity and density, generally independent of mass, for each type of material. For example, since lead is of high density and low conductivity, it would generally follow the glass and stone in reaching the lower end of the dropping zone. Fragments of lead would then be followed by fragments of zinc, copper and aluminum, presuming each of these types of metals would be present in the refuse material. As a result, at the lower end of the dropping zone, as best shown in FIG. 2 and based on a clockwise rotation of the diverter means 6, with zone 7 collecting glass and stone, then zone 8 would collect lead, a zone 9 would receive zinc, a zone 10 would receive copper and a zone 11 receive aluminum.

It is not intended to limit the present invention to any one form of diverter or deflector means at 6 nor to any one type of power operating means to effect its rotation. For pictorial purposes, the present drawing indicates that deflector member 6 is mounted at the top of a vertically oriented, rotatable shaft means 12 and that the shaft means is in turn held by bearing means at 13 and 14 to be rotated by suitable gearing at 15 and 16 which will effect a linkage with motor means 17. The entire power operating portion is housed within a shielding portion 18 such that a plurality of collection bins will be radially positioned therearound to receive the various segregated materials. It is to be understood that motor 17 will be operated responsive to the movement of conveyor belt means 1 so that there is a rotation of diverter means 6 to receive resulting segregated falling material from the mixed solids being introduced at the top of the dropping zone 2. Also, the gearing at 15 and 16 and the resulting rates of rotation for the deflector means will be sized to effect a desired synchronization with the differing rates of descent for the different material fragments. The circuitry and switching to start and stop the diverter 6 responsive to the delivery of batches of mixed metals to the top of the dropping zone is believed to be obvious and conventional and that it is unnecessary to show it in the present drawing.

Where a downward air flow is desired to help overcome air resistance to particles falling downwardly in the dropping zone, there may be air blower means provided at the upper end of such zone or, optionally, suitable air suction means connective with the lower end of the zone in order to induce the desired air flow downwardly through the dropping zone. The mechanics of connecting suitable blower means to the unit should be obvious and it is deemed unnecessary to show such types of modifications in the drawing.

It is to be further understood that the present drawing is diagrammatic and that various forms of collection bins as well as various types of diverter configurations and operations may be integrated into the present type of system to effect the deflection of material to an appropriate area. Also various types of doors or access means may be provided for each collecting bin, without departing from the overall scope of the present invention. The overall efficiency of the present operation will depend on various factors including height of the dropping zone, the quantity and sizing of solid material fragments being introduced with each batch of dropping material, and the strength and nature of the magnetic fields being provided across the dropping zone; however, there can readily be obtained a generally high accuracy and uniformity in segregation for each type of material, as related to its conductivity, and a resulting valuable separating procedure that can be integrated into an overall refuse reclaiming operation.

I claim as my invention:

1. A method for segregating mixed solids materials, including mixed metals and non-metals, that remain in refuse or waste materials after initial separations of low density materials and magnetically removable ferrous materials, which method comprises the steps of:

a. effecting the dropping of a batch of mixed solids materials downwardly through a defined vertically elongated dropping zone, b. simultaneously providing a constant magnetic field comprised of vertically spaced magnetic members or opposed sides of the dropping zone for substantially the length of the dropping zone to cause material fragments to cut through the magnetic lines of force and result in effecting retarding forces on the conductive materials of said batch proportional to the conductivity of each such piece of material and to its mass/density characteristics, c. providing a downward air current flow in interconnection with said dropping zone causing an air stream to flow downwardly at the approximate average velocity of the falling material which is to be separated such as to minimize the effects of wind resistance, d. providing timed and synchronized diversions of the solids materials at the lower end of the dropping zone by movable particle deflector means to effect a plurality of resulting time-of-flight separations for the different materials, and, e. effecting the collection of segregated types of solids and metals within different areas of said dropping zone.

2. The method of claim 1 further characterized in that said magnetic members are electromagnets which will provide magnetic lines of force across substantially the full height of said dropping zone.

3. The method of claim 1 further characterized in that the batch of mixed solids materials are dropped down through an elongated dropping zone which is confined within a non-conductive shielding zone in order to preclude interference from stray air currents and from electrical eddy-currents.

4. The method of claim 1 further characterized in that the resulting generally segregated materials reaching the lower end of the dropping zone are contacted by a rotating non-magnetic deflector zone rotating from a vertical axis, whereby particles will deflect into radially positioned collection zones.

* * * * *